US006907919B2

(12) United States Patent
Zhang

(10) Patent No.: US 6,907,919 B2
(45) Date of Patent: Jun. 21, 2005

(54) HEAT EXCHANGER LOUVER FIN

(75) Inventor: Chao A. Zhang, Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 48 days.

(21) Appl. No.: 10/618,547

(22) Filed: Jul. 11, 2003

(65) Prior Publication Data

US 2005/0006063 A1 Jan. 13, 2005

(51) Int. Cl.[7] ..... F28F 13/12
(52) U.S. Cl. ..... 165/109.1; 165/151; 165/152
(58) Field of Search ..... 165/151–153, 165/109.1, 181

(56) References Cited

U.S. PATENT DOCUMENTS

| | | | | |
|---|---|---|---|---|
| 4,550,776 A | | 11/1985 | Lu | 165/151 |
| 4,723,600 A | | 2/1988 | Yokoyama et al. | 165/151 |
| 4,787,442 A | | 11/1988 | Esformes | 165/151 |
| 4,796,694 A | * | 1/1989 | Ikuta et al. | 165/152 |
| 4,815,531 A | | 3/1989 | Presz, Jr. et al. | 165/151 |
| 4,984,626 A | | 1/1991 | Esformes et al. | 165/151 |
| 5,509,469 A | | 4/1996 | Obosu | 165/151 |
| 5,558,156 A | * | 9/1996 | Tsutsui | 165/152 |
| 5,679,106 A | | 10/1997 | Ohno et al. | 492/1 |
| 5,730,214 A | | 3/1998 | Beamer et al. | 165/152 |
| 5,738,169 A | * | 4/1998 | Stoynoff | 165/152 |
| 5,915,471 A | | 6/1999 | Kim | 165/151 |
| 5,927,393 A | | 7/1999 | Richter et al. | 165/151 |
| 6,073,686 A | | 6/2000 | Park et al. | 165/144 |
| 6,079,487 A | * | 6/2000 | Lopes et al. | 165/151 |
| 6,213,196 B1 | | 4/2001 | Ozaki et al. | 165/140 |
| 6,308,527 B1 | | 10/2001 | Kuroyanagi et al. | 62/288 |
| 6,339,937 B1 | | 1/2002 | Makihara et al. | 62/503 |
| 6,349,761 B1 | | 2/2002 | Liu et al. | 165/151 |
| 6,354,368 B1 | | 3/2002 | Nishishita et al. | 165/135 |
| 6,401,809 B1 | | 6/2002 | Zhang et al. | 165/146 |
| 6,415,855 B2 | | 7/2002 | Gerard et al. | 165/166 |
| 6,430,983 B1 | | 8/2002 | Nozaki et al. | 72/186 |
| 6,502,305 B2 | | 1/2003 | Martins et al. | 29/890.047 |
| 2002/0189799 A1 | | 12/2002 | Ozaki | 165/152 |

FOREIGN PATENT DOCUMENTS

| | | | | |
|---|---|---|---|---|
| JP | 63065299 A | * | 3/1988 | 165/151 |

* cited by examiner

*Primary Examiner*—Leonard R. Leo
(74) *Attorney, Agent, or Firm*—Brinks Hofer Gilson & Lione

(57) ABSTRACT

A heat exchanger fin includes a plurality of vortex generator louvers spaced apart, such that there is a gap between adjacent louvers through which a fluid, such as air, flows. Each vortex generator louver is provided with one or more mini-vortex generators along an outer edge of the louver. The mini-vortex generators trigger vortices that flow across the vortex generator louvers.

11 Claims, 3 Drawing Sheets

HEAT EXCHANGER LOUVER FIN

BACKGROUND

1. Technical Field

The present invention relates generally to heat exchangers. More specifically, the present invention relates to heat exchanger fins.

2. Background Information

Heat exchangers are used in many types of industries. For example, heat exchangers with louvered fins are in common usage in the automobile industry, in particular, in many air-liquid, air-refrigerant, and air—air heat exchangers. To provide the required heat transfer capability in these applications, the heat exchangers are typically large and therefore do not lend themselves to compact packaging. Moreover, their large size makes them expensive to fabricate.

While these large heat exchangers work sufficiently well for their intended purposes, for cost cutting and compact packaging reasons, original equipment manufacturers are now demanding miniaturized heat exchangers. Unfortunately, the smaller heat exchangers are less efficient than their larger counterparts and therefore do not meet the heat transfer requirements.

From the above, it is seen that there exists a need for an improved heat exchanger with enhanced heat transfer capabilities that can be provided in a compact package.

BRIEF SUMMARY

In overcoming the above mentioned and other drawbacks, the present invention provides a heat exchanger fin that incorporates one or more vortex generator louvers. The fin provides enhanced heat transfer performance with the use the vortex generator louvers, such that the performance of these efficient fins is comparable or exceeds that of conventional fins that do not include vortex generator louvers.

In general, each vortex generator louver is provided with mini-vortex generators along an outer edge of the louver. These louvers are placed towards the front of the fin so that the mini-vortex generators trigger vortices which effectively thins the thermal boundary layer across the louver, thereby enhancing the heat transfer performance of the heat exchanger.

The heat exchanger fin may include a plurality of louvers spaced apart, such that there is a gap between adjacent louvers through which a fluid, such as air, flows. The mini-vortex generators may be protuberances extending from respective outer edges of the vortex generator louvers. The fin may also include a plurality of non-vortex generator louvers.

Depending on the application of the fin, the proportion of vortex generator louvers to non-vortex generator louvers may be between about 20% and 50%. The protuberance may be inclined at an angle relative to a planar portion of the vortex generator louver. For example, the angle of inclination may be between about 30° and 45°. Each protuberance may have a triangular shape that generates a pair of counter-rotating vortices as the fluid encounters the tip of the protuberance.

The foregoing discussion has been provided only by way of introduction. Nothing in this section should be taken as a limitation on the following claims, which define the scope of the invention.

BRIEF DESCRIPTION OF THE DRAWINGS

The accompanying drawings, incorporated in and forming a part of the specification, illustrate several aspects of the present invention and, together with the description, serve to explain the principles of the invention. The components in the figures are not necessarily to scale, emphasis instead being placed upon illustrating the principles of the invention. Moreover, in the figures, like reference numerals designate corresponding parts throughout the views. In the drawings.

DETAILED DESCRIPTION

Figure 1:
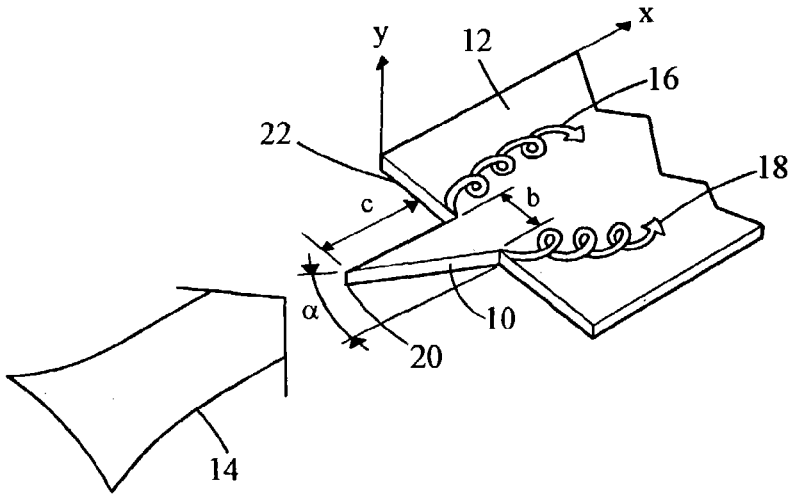
FIG. 1 illustrates the fluid dynamics of fluid flow over a mini-vortex generator.

As an overview of the vortex generation principles employed in the present invention, FIG. 1 depicts a mini-vortex generator 10 attached to a flat plate 12 and positioned at an angle ($\alpha$) from the plane of the plate 12. The mini-vortex generator 10 is, for example, a triangular shaped protuberance having a length (c) and a base with a width (b). As air flows in the direction of arrow 14 over the mini-vortex generator 10, the tip 20 of the mini-vortex generator 10 triggers a pair of counter-rotating vortices 16 and 18 which flow from the trailing edge of the mini-vortex generator 10 (or the leading edge 22 of the plate 12) across the plate 12.

Looking downstream from the tip 20 (i.e. in the direction of arrow 14), the vortex 16 rotates clockwise as it moves across the plate 12, while the vortex 18 rotates counterclockwise. The rotation of the vortices 16, 18 enhances the mixing of the fluid, such as air, as it flows across the plate 12. Hence, if the fluid is hotter than the plate 12, the vortex mixing brings the hotter fluid towards the plate. And as heat is rejected from the fluid to the plate, the vortex mixing takes the cooler fluid away from the plate. Such mixing enhances the heat exchange capability of the plate 12 over that which would occur without vortex mixing.

Typically, without the mini-vortex generator 10, the boundary layer over the plate 12 is laminar, increasing in thickness from the leading edge 22 of the plate 12 towards its trailing edge. With the use of the mini-vortex generator 10, the vortices 16,18 effectively thins the boundary layer, which resists heat transfer less than a thicker boundary layer, thereby increasing the heat exchange capabilities of the plate 12.

Figure 2:
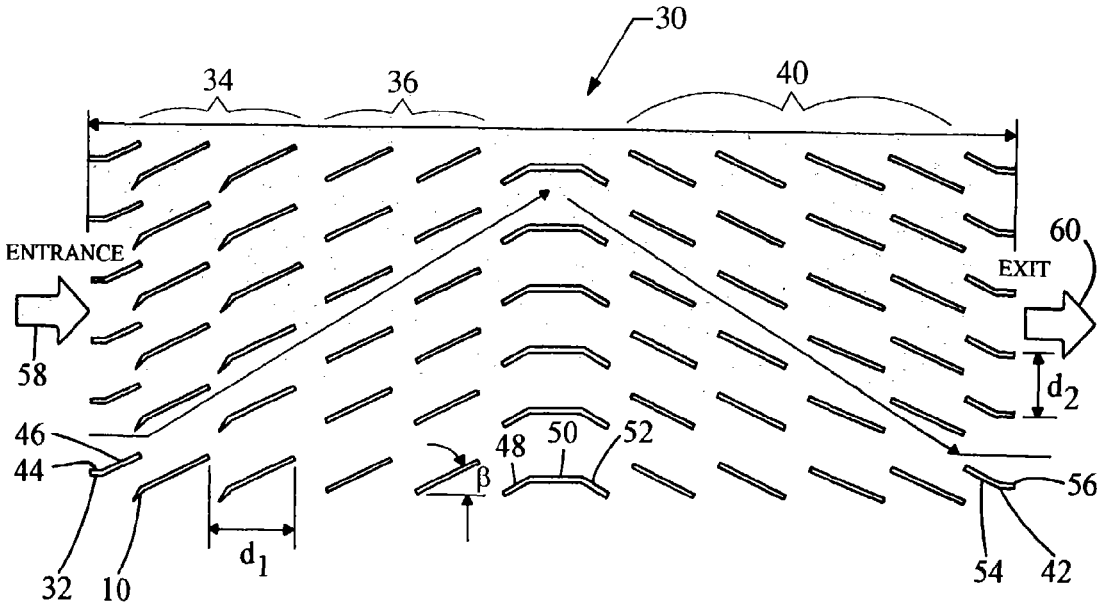
FIG. 2 is a cross-sectional view of a louver fin with mini-vortex generator louvers in accordance with the invention.

Referring now to FIG. 2, there is shown a heat exchanger fin 30 that employs mini-vortex generators for enhanced heat exchange capabilities in accordance with the invention. The fin 30 includes a set of entrance louvers 32, a set of vortex generator louvers 34, a set of forward regular louvers 36, a set of turnaround louvers 50, a rear set of regular louvers 40, and a set of exit louvers 42. Each mini-vortex generator louver 34 is provided with a set of mini-vortex generators 10, such as those described with reference to FIG. 1, extending from a planar portion of the louver. As shown, the mini-vortex generators 10 are angled downwards from the planar portion of the louvers 34. Alternatively, the mini-vortex generators can be angled upwards.

For this illustrated embodiment, there is one column of entrance louvers 32, two columns of vortex generator louvers 34, two columns of forward regular louvers 36, one column of turnaround louvers 50, four columns of rear regular louvers 40, and one column of exit louvers 42. Each column has six of the respective louvers, so that in this example there are twelve vortex generator louvers 34 (i.e. two columns of louvers, each column having six louvers). However, depending on the particular application, there may be as many as 200 or more louvers in each column. Moreover, there can be three to six or more columns of the vortex generator louvers 34. Typically, the proportion of the columns of the vortex generator louvers 34 to the columns of the forward regular louvers 36 is between about 20% to 50%.

The entrance louvers 32 have a horizontal portion 44 and an angled portion 46. The angle of inclination of the angled portion 46 matches the angle of inclination of the vortex generator louvers 34, the forward set of the regular louvers 36, as well as a front portion 48 of the turnaround louvers 50, as indicated by the angle ($\beta$), which is about 45° in this example. The turnaround louvers 50 are also provided with a reverse angled portion 52 that matches the angle of inclination of the rear set of regular louvers 40 and an angled portion 54 of the exit louvers 42, which are also provided with a horizontal portion 56.

The louver pitch ($d_1$) between the mini-vortex generator louvers 34 is between about 0.8 mm to 1.5 mm, and the fin pitch ($d_2$) is between about 0.8 mm to 1.8 mm. Although the louver pitch ($d_1$) and the fin pitch ($d_2$) between respective louvers are shown to be the same, either or both of the pitches may be different depending on the application requirements of the fin 30.

When the fin 30 is in use, air enters the fin 30 as indicated by the arrow 58. The entrance louvers 32 divert the air upwards over the vortex generator louvers 34, as indicated by the upward angled arrow. The mini-vortex generators 10 of the vortex generator louvers 34 trigger vortices in the airflow, thereby thinning the thermal boundary layer, as discussed earlier, and hence enhancing the heat transfer capabilities of the heat exchanger fin 30. The air flows past the forward set of regular louvers 36 and is diverted downwards by the turnaround louvers 50, past the rear set of regular louvers 40, as indicated by the downward angled arrow, and exits through the exit louvers 42 in the direction of the arrow 60.

Figure 3A:
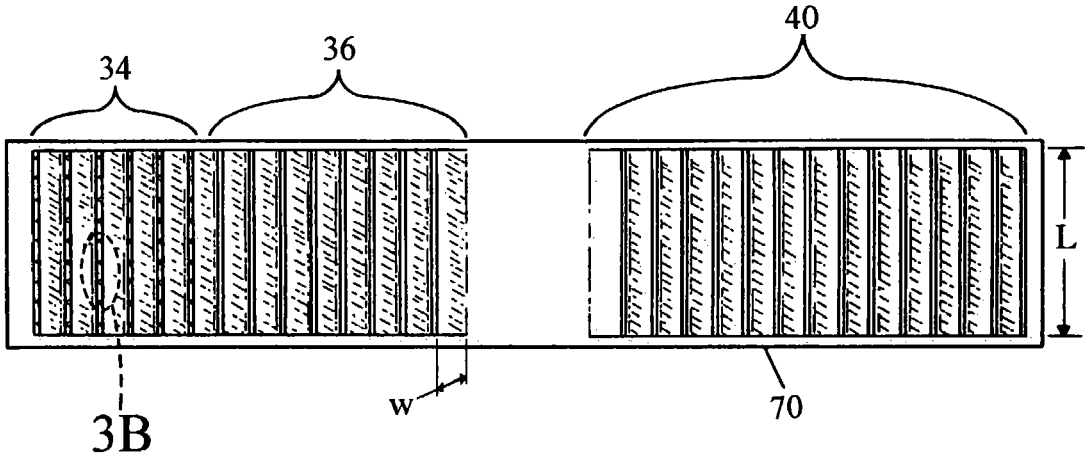
FIG. 3A depicts a louver fin viewed along the line 3A of FIG. 4 featuring vortex generator louvers in accordance with the invention.
Figure 4:
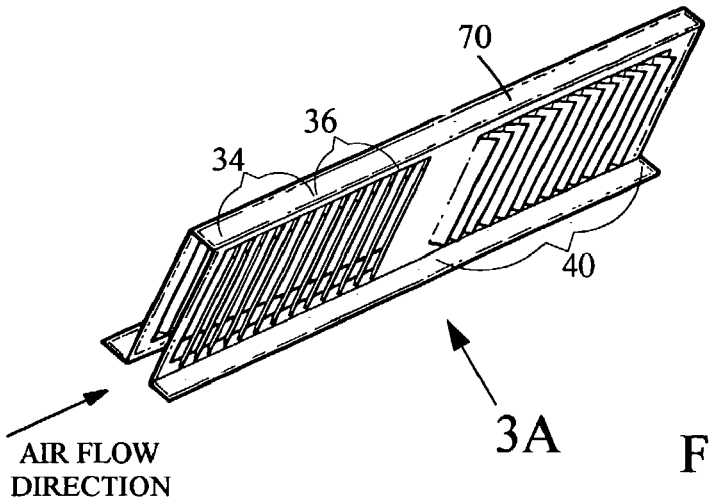
FIG. 4 illustrates a heat exchanger with a pair of louver fins in accordance with the invention.

Illustrated in FIG. 4 is an example of a heat exchanger fin generally identified by the reference numeral 70. A portion of the fin 70 is shown in FIG. 3A with vortex generator louvers 34, forward regular louvers 36, and rear regular louvers 40. In this embodiment, the louvers 34, 36, 38 have a length (L) of about 6 mm to 10 mm and a width (w) of about 0.8 mm to 1.5 mm. Note that depending upon the application of the fin 70, the length and width of the louvers can be smaller or greater than the aforementioned dimensions.

Figure 3B:
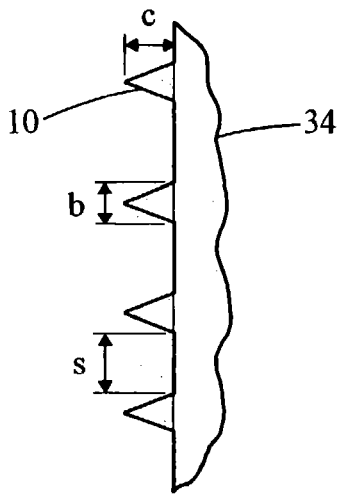
FIG. 3B is a view of a portion of a vortex generator louver with mini-vortex generators in accordance with the invention.

Referring in particular to FIG. 3B, each vortex generator louver 34 includes a set mini-vortex generators 10 along the outer edge of the louver. Each louver 34 can have as few as one mini-vortex generator 10 or as many as eight to nine or more mini-vortex generators. In some embodiments, the mini-vortex generators 10 are spaced apart by about 1 mm, and each mini-vortex generator 10 has a length (c) of less than about 1 mm and a base width (b) of less than about 1 mm. In a particular embodiment, the length (c) and base width (b) are each about 0.4 mm. The mini-vortex generators 10 can have an angle of inclination ($\alpha$), as shown for example in FIG. 1, in the range of about 30° to 45°. Again, depending upon the application of the fin 70, these dimensions can be smaller or greater than those just mentioned.

Figure 5:
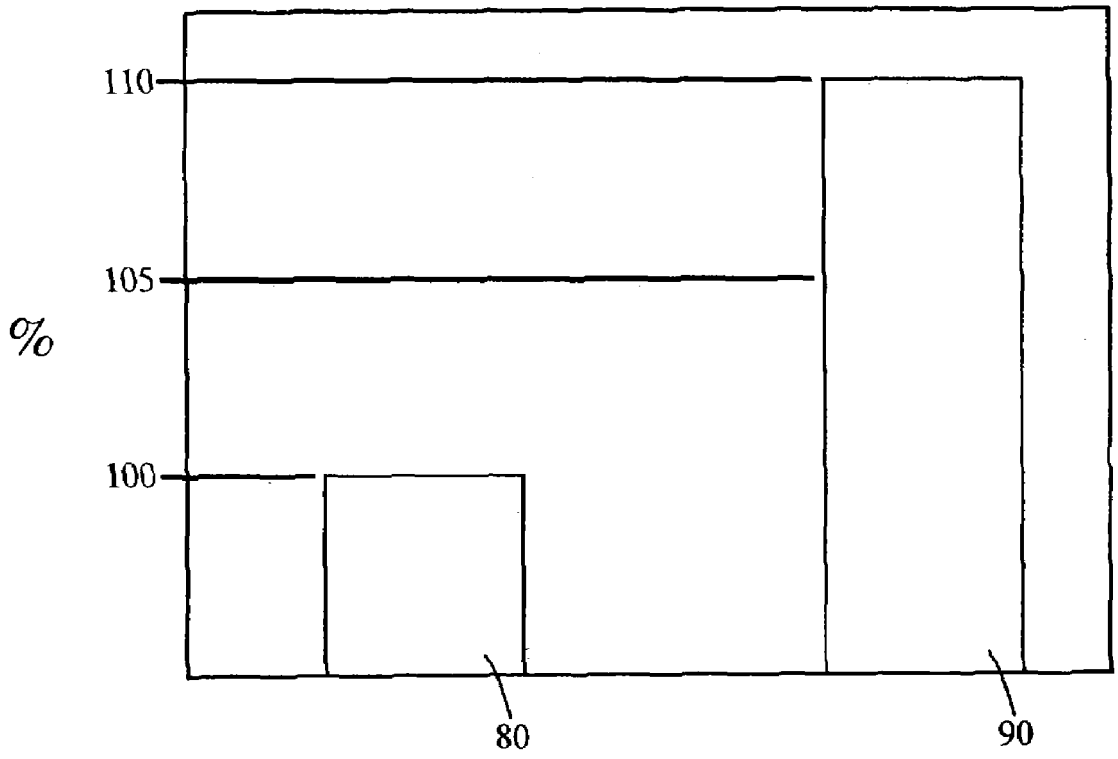
FIG. 5 is a bar graph of the test results of the heat transfer enhancements of louver fin with min-vortex generators as compared to a conventional louver fin without mini-vortex generators.

FIG. 5 illustrates the enhanced performance provided by a fin with vortex generator louvers in accordance with the invention. As shown, the fin with vortex generator louvers, provided with mini-vortex generators 10, has a heat rejection capability of about 100% to 110%, as indicated by the bar 90, while a fin that is not provided with such vortex generator louvers has a base performance of 100%, as indicated by the bar 80.

It is therefore intended that the foregoing detailed description be regarded as illustrative rather than limiting, and that it be understood that it is the following claims, including all equivalents, that are intended to define the spirit and scope of this invention.

What is claimed is:

1. A heat exchanger fin for a vehicle, comprising:

a plurality of louvers spaced apart, the spacing of adjacent louvers defining a gap therebetween, at least one of the plurality of louvers being a vortex generator louver provided with at least one mini-vortex generator, the mini-vortex generator being a protuberance extending from an outer edge of the vortex generator louver and having a triangular shape with a base and a length, the mini-vortex generator generating a pair of counter-rotating vortices in a fluid as the fluid encounters the mini-vortex generator.

2. The heat exchanger fin of claim 1, wherein the proportion of vortex generator louvers to non-vortex generator louvers is between about 20% to 50%.

3. The heat exchanger fin of claim 1, wherein the mini-vortex generator louver is positioned towards the front of the fin facing the incoming fluid.

4. The heat exchanger fin of claim 1, wherein the vortex generator louver includes two or more mini-vortex generators spaced apart by about 1 mm.

5. The heat exchanger fin of claim 1, wherein the protuberance is inclined at an angle relative to a planar portion of the vortex generator louver.

6. The heat exchanger fin of claim 5, wherein the angle is between about 30° and 45°.

7. The heat exchanger fin of claim 1, wherein the width of the base and the length are about equal.

8. The heat exchanger fin of claim 7, wherein the width of the base and the length are less than about 1 mm.

9. The heat exchanger fin of claim 8, wherein the width of the base and the length are about 0.4 mm.

10. The heat exchanger fin of claim 1, wherein the length of the louvers is between about 6 mm to 10 mm.

11. The heat exchanger fin of claim 1, wherein the width of the louvers is between about 0.8 mm to 1.5 mm.

* * * * *